US005397197A

United States Patent [19]

Beavers

[11] Patent Number: 5,397,197

[45] Date of Patent: Mar. 14, 1995

[54] RESILIENT BOLLARD WITH ROTATABLE COLLAR FOR ALERTING VEHICLES OF THEIR LOCATION

[76] Inventor: Dale W. Beavers, 200 Deer Creek, Powell, Ohio 43065

[21] Appl. No.: 72,500

[22] Filed: Jun. 4, 1993

[51] Int. Cl.[6] ..... E01F 9/01

[52] U.S. Cl. ..... 404/10; 404/11; 116/63 R

[58] Field of Search ..... 404/6, 9, 10, 11, 13; 116/63 R, 63 P; 256/13.1, 1; 40/608, 612

[56] References Cited

U.S. PATENT DOCUMENTS

| | | | |
|---|---|---|---|
| 1,903,869 | 4/1933 | Meister et al. | 40/608 |
| 3,416,484 | 12/1968 | Chapman | 404/10 X |
| 3,442,187 | 5/1969 | Hausegger | 94/1.5 |
| 3,602,109 | 8/1971 | Harrington | 94/1.5 |
| 3,664,583 | 5/1972 | Allen | 238/5 |
| 3,693,940 | 9/1972 | Kendall et al. | 256/1 |
| 3,838,661 | 10/1974 | Medley, Jr. | 116/63 P |
| 4,270,873 | 6/1981 | Laehy et al. | 404/10 |
| 4,373,464 | 2/1983 | Blau | 116/63 |
| 4,435,106 | 3/1984 | Forster et al. | 404/6 |
| 4,515,499 | 5/1985 | Furiate | 404/6 |
| 4,573,109 | 2/1986 | Lack | 362/194 |
| 4,662,611 | 5/1987 | Ruane | 256/13.1 |
| 4,759,161 | 7/1988 | Kucyk, Jr. et al. | 404/10 X |
| 4,923,327 | 5/1990 | Gorlov | 404/6 |
| 5,018,902 | 5/1991 | Miller et al. | 404/6 |
| 5,029,783 | 7/1991 | Alvarez | 40/608 X |
| 5,053,868 | 10/1991 | Higgins et al. | 358/93 |
| 5,105,347 | 4/1992 | Ruud et al. | 362/268 |
| 5,265,556 | 11/1993 | Hall | 404/9 X |

FOREIGN PATENT DOCUMENTS

| | | | |
|---|---|---|---|
| 0156158 | 10/1985 | European Pat. Off. | 404/9 |
| 0355344 | 2/1990 | European Pat. Off. | 404/10 |
| 2534290 | 4/1984 | France | 404/9 |
| 2622613 | 5/1989 | France | 404/10 |
| 2093892 | 9/1982 | United Kingdom | 116/63 R |
| 2107446 | 4/1983 | United Kingdom | 404/9 |

*Primary Examiner*—Ramon S. Britts
*Assistant Examiner*—James A. Lisehura
*Attorney, Agent, or Firm*—Mueller and Smith

[57] ABSTRACT

The present invention is directed to a bollard made of an elongate member having a lower proximal end biasedly attachable in an upright position to a path surface, an upper distal end, and a longitudinal axis. A collar is attached to the elongate member about its upper distal end. The collar is rotatable about the longitudinal axis of the elongate member. When such bollard is mounted on or adjacent a path surface, the bollard is deflectable from its upright position about its proximal end, e.g., when contacted by a vehicle. The collar rotates when in contact with the vehicle for following the contour of the vehicle without damaging the vehicle. Specific bollard configurations are disclosed herein along with numerous attachments with which the inventive bollard can be outfitted.

17 Claims, 3 Drawing Sheets

RESILIENT BOLLARD WITH ROTATABLE COLLAR FOR ALERTING VEHICLES OF THEIR LOCATION

BACKGROUND OF THE INVENTION

The present invention relates to bollards such as are used to alert traffic of an obstacle to be avoided and more particularly to a bollard which is designed not to be destroyed when struck by a vehicle and which does not damage the vehicle when struck.

Many types of roadway barriers have been proposed over the years and many varieties presently are in use. Bollards or post can be placed between lanes of traffic for traffic lane delineation or placed in parking lots to control where vehicles can travel. Bollards also can be placed adjacent drive-through windows of restaurants or an automatic bank teller machine (ATM) to protect the building and direct the vehicle to a proper position adjacent the window, and like uses. Fixed bollards are not desired in many of these instances as they can cause damage to the vehicles when struck which damage can result in significant claims being paid by the owner of the property and/or their insurance carder. Collapsible bollards are known in the art, though often these collapsible bollards themselves are damaged when struck by a vehicle or, more typically, damage the vehicle so that the owner of the property again is exposed to potential damage claims. Some of these prior bollard proposals are set forth below.

U.S. Pat. No. 3,602,109 shows a barrier assembly comprising a series of individual guard-roll barrier units which comprise a series of inverted frustroconical rollers which guide an errant automobile along a safe path. U.S. Pat. No. 5,105,347 shows that bollards can be illuminated. U.S. Pat. No. 4,515,499 shows that traffic lane bollards can be mounted on a spring for providing a return mechanism when struck by automobiles. U.S. Pat. No. 5,018,902 proposes a bollard which is collapsible with an ordinary fire hydrant wrench. U.S. Pat. No. 4,373,464 proposes a bollard which has a flexible column surrounded by a coil spring which has a cover thereover and is collapsible when struck by a vehicle. U.S. Pat. No. 3,442,187 shows a similar spring containing bollard which collapses when struck by a vehicle.

Despite the proposals for collapsible bollards, there still is a significant need in the art to design a bollard that can be collapsible so that the bollard itself is not damaged each time it is struck by a vehicle while concomitantly protecting the vehicle against damage when the bollard is struck by the vehicle. The present invention is directed to such a bollard development.

BROAD STATEMENT OF THE INVENTION

The present invention is directed to a bollard made of an elongate member having a lower proximal end biasedly attachable in an upright position to a path surface, an upper distal end, and a longitudinal axis. A collar is attached to the elongate member about its upper distal end. The collar is rotatable about the longitudinal axis of the elongate member. When such bollard is mounted on or adjacent a path surface, the bollard is deflectable from its upright position about its proximal end, e.g., when contacted by a vehicle. The collar rotates when in contact with the vehicle for following the contour of the vehicle without damaging the vehicle. Specific bollard configurations are disclosed herein along with numerous attachments with which the inventive bollard can be outfitted.

Advantages of the present invention include a bollard which can be deflected from its upright position when contacted by a vehicle without damaging the bollard while concomitantly minimizing any damage to the vehicle. Another advantage is a bollard that is easy to manufacture and install. Another advantage is a bollard design that can be used in a wide variety of situations from controlling foot traffic to bicycle traffic to vehicle traffic. These and other advantages will be readily apparent to those skilled in the art based upon the disclosure contained herein.

The drawings will be described in detail in connection with the following description.

DETAILED DESCRIPTION OF THE INVENTION

Figure 1:
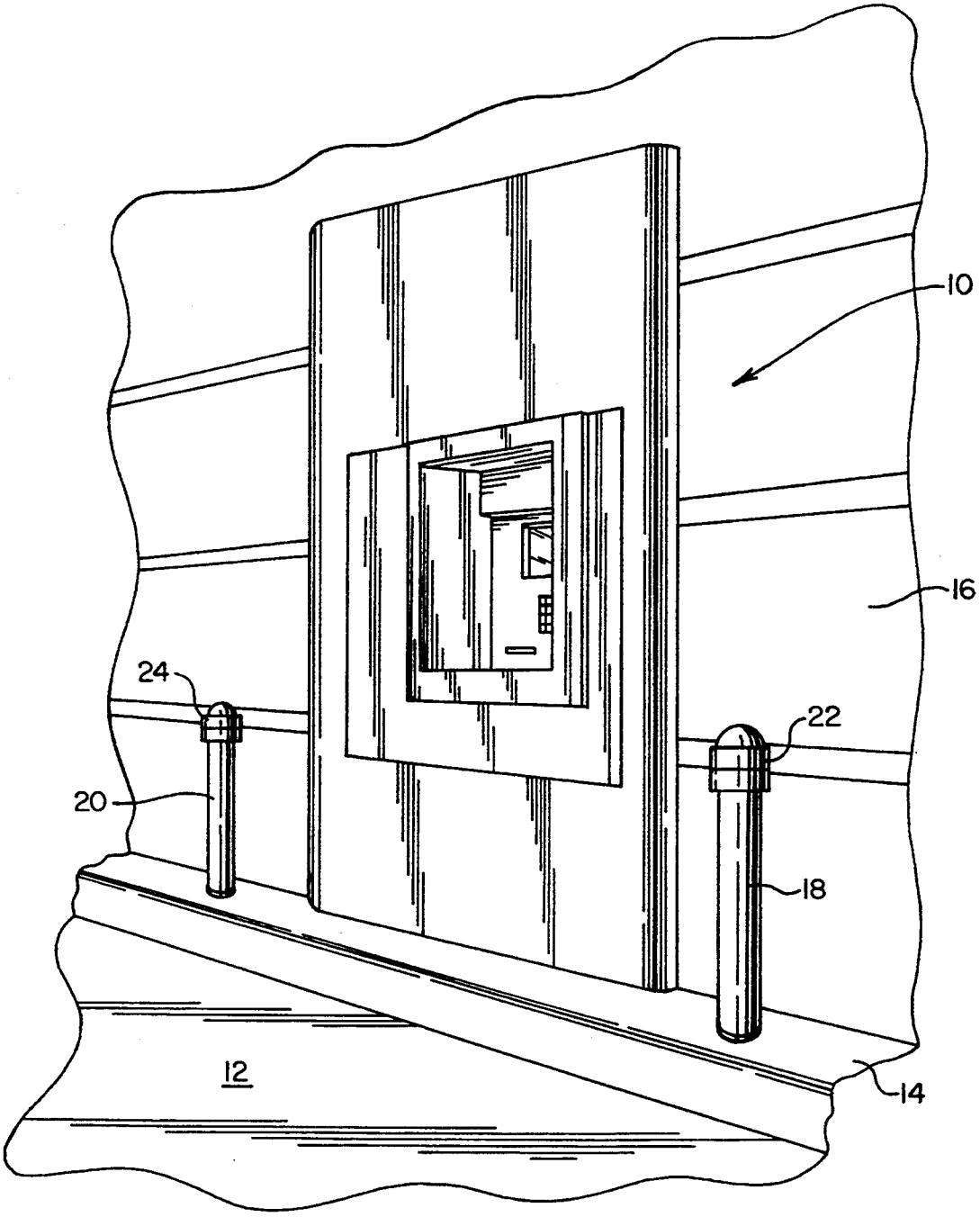
FIG. 1 is a perspective view of a bank automatic teller machine (ATM) having a pair of the inventive bollards established in a curb adjacent the machine for preventing vehicles from accidentally striking the machine when driving up to the machine for using it.

One of the applications for the novel bollard disclosed herein is to control automobiles from coming too close to and/or striking drive-through structures, such as found in restaurants and banks. Illustrative of the present invention, then, is ATM (automatic teller machine) 10 as shown in FIG. 1. It will be observed that automobiles approach ATM 10 via drive 12 wherein curb 14 is intended to keep vehicles from striking structure 16 which houses ATM 10. In order for the passenger to reach the control panel of ATM 10, however, it is located close enough to roadway 12 that a vehicle can strike it unintentionally. Thus, bollards 18 and 20 are intended to prevent the automobile from striking ATM 10. Such bollards, however, when made of rigid metal or the like, can damage the automobile, resulting in a claim potentially being filed against the bank. Bollards that are flexible also can damage the automobiles which does not lower the claim risk to the bank. Inventive bollards 18 and 20 have collar pairs 22 and 24, respectively, which roll along the contact area of the vehicle for preventing (or at least minimizing) any damage to the vehicle. The bollards are resilient in that they can be deflected from their upright position when sufficient force is applied to them by the automobile and then return to their upright position once contact by the vehicle is eliminated.

Figure 2:
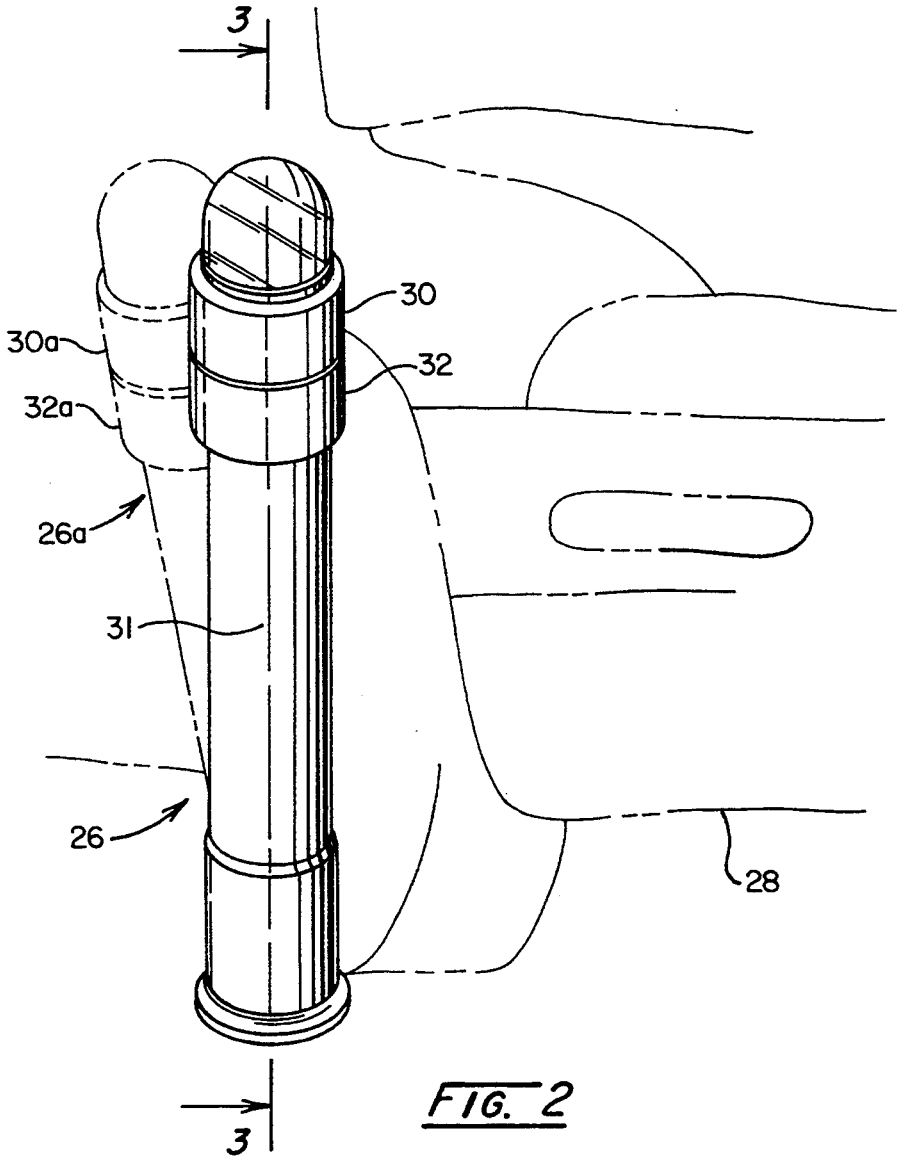
FIG. 2 is a perspective elevational view of the inventive bollard in its fixed upright position with an automobile striking the bollard shown in phantom as well as deflection of the bollard from its upright position shown in phantom.

Such deflection can be seen by referring to FIG. 2 wherein bollard 26 is shown being struck by automobile 28 (in phantom) which causes bollard 26 to be deflected to the phantomed position identified at 26a. A pair of collars, 30 and 32 (and correspondingly 30a and 32a for deflected bollard 26a shown in phantom) rotate about the longitudinal axis of bollard 26 for minimizing any damage to vehicle 28. When vehicle 28 is moved out of contact with bollard 26a, bollard 26a returns to its normal upright position 26.

Figure 3:
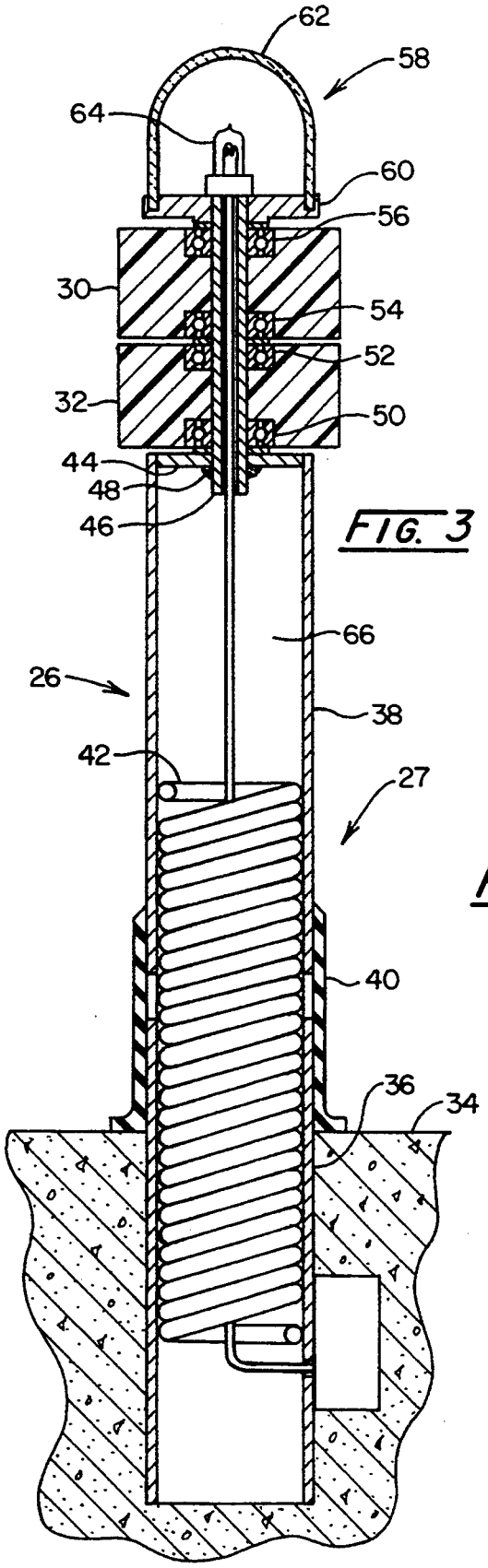
FIG. 3 is a cross-sectional elevational view of the inventive bollard taken along line 3—3 of FIG. 2.

Looking to FIG. 3 which is a sectional view of bollard 26 taken along line 3—3, it will be observed that bollard 26 is securely attached to concrete 34 at its lower proximal end with a biasing assembly, shown generally at 27; although, it should be understood, that bollard 26 could be embedded in pavement, earth, or layers of such materials. Into concrete 34 is placed rigid lower elongate hollow tube 36 which can be manufactured of, for example, polymeric material or metal optionally constructed of or treated to be resistant to corrosion. Upper elongate hollow tube 38 is spaced apart from tube 36 with rubber grommet 40 sealing such gap therebetween and sealing tube 36 to concrete 34, e.g., to prevent infiltration of moisture, din, or like foreign matter.

Coil spring 42 is disposed within both tubes 36 and 38 under compression for providing connection therebetween. The spring constant is designed suitably so that a minimum force is required for deflecting bollard 26 from the upright position to its deflected position as depicted at FIG. 2.

Upper distal end of tube 38 has a hole penetrating in end plate 44 through which elongate member 46 is inserted and welded at its lower proximal end, as at weld 48. Mounted around elongate member 46 are collars 30 and 32 which rotate about longitudinal axis 31 (see FIG. 2) of bollard 26. Ball bearing assemblies 50–56 permit collars 30 and 32 to freely rotate when contacted by an automobile or other vehicle. As such collars rotate, they follow the outer surface and configuration of the automobile which controls the angle of deflection of bollard 26 and minimizes damage to the vehicle in contact therewith.

Figure 4:
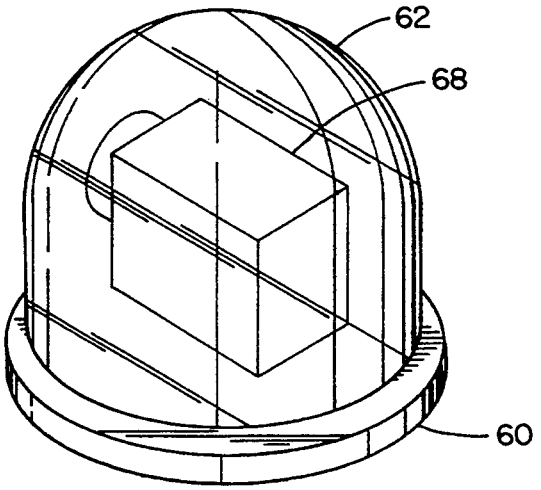
FIG. 4 is a perspective view of the upper cap or dome of the bollard showing a TV camera mounted therein.

Mounted atop bollard 26 is illumination fixture 58 composed of plate 60 which is screwed onto the threads formed in the upper distal end of elongate member 46, dome 62 which suitably is made of light transmissive plastic (optionally colored or tinted) material, and light bulb or LED 64 which is connected to a source of electrical power via line 66. It will be appreciated that fixture 58 could simply be colored material, light reflective material, or even video camera 68 as shown in FIG. 4. In other words, there is virtually no limit to the function and accessories which can be adapted to fixture 58 depending upon location and use of bollard 26.

It will be appreciated that a variety of mechanisms for flexibly mounting the bollard to the ground suitably can be envisioned in addition to the coil spring depicted in FIG. 3. For example, an alternative biasing arrangement is shown generally at 71 in FIG. 5 for bollard 70. For bollard 70, elongate annular sleeve 72 also is embedded in concrete or other ground material 34 (lower proximal end of bollard 70) with upper elongate member 74 also in spaced-apart relationship therefrom. Flexible protective sleeve 76, suitably made of elastomeric or plastic material, covers tube 74 and extends down to ground level of concrete 34. Sleeve 76 can provide additional protection to the bollard, can add color to the bollard, can contain advertising, can contain directions for traffic, or the like. Mounted atop tube 74 (upper distal end of bollard 70) in upper plate 78 is elongate member 80 which also is welded in position at its lower proximal end, as at weld 82. The upper distal end of elongated member 80 is threaded for receiving cap or dome 84 which suitably can be, for example, brightly colored or light reflecting, plastic, metal, ceramic, or other material. Collars 86–90 are retained about elongate member 80 and similarly ride upon ball bearing assemblies 92–102. It will be appreciated that one or more collars can surmount the bollard. For that matter, the collars can extend all the way down to the ground if necessary, desirable, or convenient.

Figure 5:
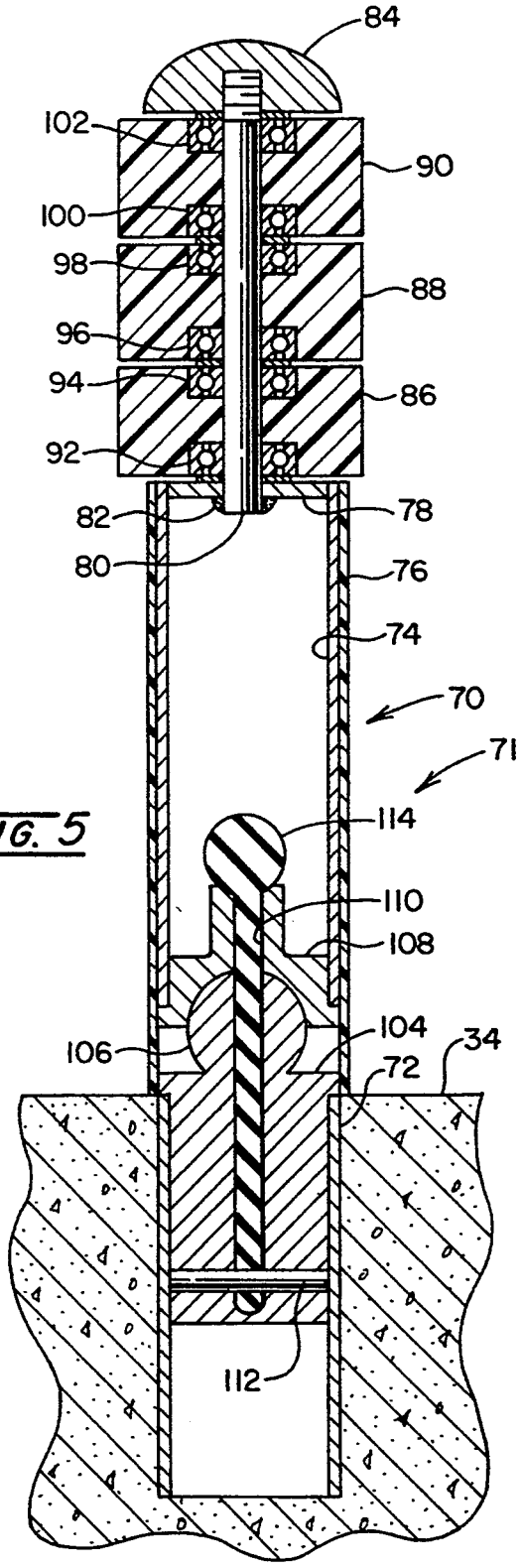
FIG. 5 is a view like that of FIG. 3 showing an alterative bias mount, a different number of rollers about its upper distal end, and a different upper cap or dome arrangement.

The mechanism permitting the bollard to be deflected from its upright position and return subsequent to being struck by an automobile, however, is much different than the coil spring mechanism shown in connection with FIG. 3. Disposed down into tube 72 is resilient member 104 which bears upper ball 106 at its upper distal end. Extending into lower proximal end of tube 74 is flexible member 108 which has a lower hemispherical recess adapted to tightly fit and conform to ball 106. Such ball and joint assembly of members 104 and 108 secure lower tube 72 to upper tube 74 and permit upper robe 74 to be deflected from an upright position when bollard 70 is struck, for example, by a vehicle. Resiliency is provided by flexible member 110 which extends through member 108 and 104, and is secured by pin 112 to lower proximal end member 104 and tube 72. Upper ball 114 at the upper distal end of pin 110 secures flexible rod 110 at its upper distal end as shown at FIG. 5. By suitably adjusting the flexibility or resiliency of members 104, 108, and 110, the force required to deflect bollard 70 from an upright can be determined and designed.

It will be appreciated that a variety of additional means for permitting the bollard to be deflected from an upright position by a vehicle and return after contact is discontinued can be envisioned by those skilled in the art based upon the disclosure contained herein. For that matter, the upper and lower tubes shown for bollards 26 and 70 need not be made of metal, but can be made of polymeric (plastic) or even ceramic material depending upon needs and requirements of the bollard. Inasmuch as the bollard can be used for safety purposes to protect property as depicted at FIG. 1, to delineate traffic, and a variety of other uses, the materials of construction may change as would the degree of force required to deflect the bollards. Such uses also will dictate the cap or dome assembly that will surmount the bollard. While concrete 34 has been shown as the path surface in which the bollard is mounted, it will be appreciated that virtually any material can have one of the novel bollards mounted thereinto.

I claim:

1. A bollard, which comprises:

(a) an elongate member having a first diametric extent and extending along a longitudinal axis from an upper distal end to a lower proximal end;

(b) a collar freely rotatably mounted about said elongate member along said longitudinal axis, said collar rotating freely about said longitudinal axis when said collar is contacted by a moving vehicle;

(c) an upper elongate tube having an upper distal end coupled to the lower proximal end of said elongate member and a lower proximal end biasedly attachable to a path surface, said upper elongate tube having a second diametric extent extending beyond the first diametric extent of said elongate member; and (d) a biasing assembly coupled to said upper elongate tube for attaching the lower proximal end thereof to the path surface, said biasing assembly orienting said bollard in a normally upright position and providing for the resilient deflection thereof from said upright position when said bollard is contacted with a predetermined amount of force by said moving vehicle.

2. The bollard of claim 1, wherein said biasing assembly comprises:

a lower elongate tube having an upper distal end resiliently coupled to the lower proximal end of said upper elongate tube and a lower distal end for fixed attachment below the path surface; and a flexible spring member which extends between a first end housed within the lower proximal end of said upper elongate tube and a second end housed within the upper distal end of said lower elongate tube for effecting the resilient coupling therebetween.

3. The bollard of claim 1, wherein said bollard contains a source of illumination mounted atop the upper distal end of said elongate member.

4. The bollard of claim 1, wherein said bollard contains a video camera mounted atop the distal end of said elongate member.

5. The bollard of claim 1, wherein said biasing assembly comprises:

an upper elongate tube having an upper distal end coupled to the lower proximal end of said elongate member and a lower proximal end;

a lower elongate tube having an upper distal end resiliently coupled to the lower proximal end of said upper hollow elongate tube and a lower distal end for fixed attachment below the path surface;

a first annular elastomeric member housed within said lower elongate tube and having an upper ball which extends beyond the upper distal end of said lower elongate tube;

a second annular elastomeric member housed within the lower proximal end of said upper elongate tube and having a hemispherical recess, said upper ball of said first elastomeric member snugly fitting within said hemispherical recess of said second elastomeric member; and a third elastomeric member which extends through said first and said second annular elastomeric member for effecting the resilient coupling between the upper distal end of said lower elongate tube and the lower proximal end of said upper elongate tube.

6. The bollard of claim 1, further comprising a ball bearing assembly interposed between said collar and said elongate member, said collar being freely rotatable about said longitudinal axis on said ball bearing assembly.

7. The bollard of claim 1, which is mounted into a path surface.

8. The bollard of claim 1 having a plurality of collars mounted along said longitudinal axis.

9. The bollard of claim 1, wherein said elongate member is rigid.

10. A method for alerting vehicles on or adjacent a path surface comprising the steps of:

(a) providing a bollard, which comprises:

an elongate member having a first diametric extent and extending along a longitudinal axis from an upper distal end to a lower proximal end;

a collar freely rotatably mounted about said elongate member along said longitudinal axis, said collar rotating freely about said longitudinal axis when said collar is contacted by a moving vehicle;

an upper elongate tube having an upper distal end coupled to the lower proximal end of said elongate member and a lower proximal end biasedly attachable to a path surface, said upper elongate tube having a second diametric extent extending beyond the first diametric extent of said elongate member; and a biasing assembly coupled to said upper elongate tube for attaching the lower proximal end thereof to the path surface, said biasing assembly orienting said bollard in a normally upright position and providing for the resilient deflection thereof from said upright position when said bollard is contacted with a predetermined amount of force by said moving vehicle, and (b) mounting said bollard on or adjacent said path surface for contact by said vehicle for alerting said vehicle of its location.

11. The method of claim 10, wherein said biasing assembly of said bollard comprises:

a lower elongate tube having an upper distal end resiliently coupled to the lower proximal end of said upper elongate tube and a lower distal end for fixed attachment below the path surface; and a flexible spring member which extends between a first end housed within the lower proximal end of said upper elongate tube and a second end housed within the upper distal end of said lower elongate tube for effecting the resilient coupling therebetween.

12. The method of claim 10, wherein said bollard is provided with a source of illumination mounted atop the upper distal end of said elongate member.

13. The method of claim 10, wherein said bollard is provided with a video camera mounted atop the distal end of said elongate member.

14. The method of claim 10, wherein said biasing assembly of said bollard comprises:

an upper elongate tube having an upper distal end coupled to the lower proximal end of said elongate member and a lower proximal end;

a lower elongate tube having an upper distal end resiliently coupled to the lower proximal end of said upper hollow elongate tube and a lower distal end for fixed attachment below the path surface;

a first annular elastomeric member housed within said lower elongate tube and having an upper ball which extends beyond the upper distal end of said lower elongate tube;

a second annular elastomeric member housed within the lower proximal end of said upper elongate tube and having a hemispherical recess, said upper ball of said first elastomeric member snugly fitting within said hemispherical recess of said second elastomeric member; and a third elastomeric member which extends through said first and said second annular elastomeric member for effecting the resilient coupling between the upper distal end of said lower elongate tube and the lower proximal end of said upper elongate tube.

15. The method of claim 10 wherein said bollard further comprises a ball bearing assembly interposed between said collar and said elongate member, said collar being freely rotatable about said longitudinal axis on said ball beating assembly.

16. The method of claim 10 wherein said bollard has a plurality of collars mounted along said longitudinal axis.

17. The method of claim 10, wherein said elongate member if said bollard is rigid.

* * * * *